US006893237B2

(12) United States Patent
Yamanaka et al.

(10) Patent No.: US 6,893,237 B2
(45) Date of Patent: May 17, 2005

(54) HORIZONTAL COMPRESSOR

(75) Inventors: Masaji Yamanaka, Tatebayashi (JP); Etsuo Toriyama, Ora-gun (JP); Manabu Takenaka, Oota (JP); Yoshihisa Kogure, Ora-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 1 day.

(21) Appl. No.: 10/387,373

(22) Filed: Mar. 14, 2003

(65) Prior Publication Data

US 2003/0175140 A1 Sep. 18, 2003

(30) Foreign Application Priority Data

Mar. 18, 2002 (JP) ..... 2002-074772

(51) Int. Cl.[7] ..... F04C 18/00

(52) U.S. Cl. ..... 418/60; 418/97; 418/270; 184/6.16

(58) Field of Search ..... 418/60, DIG. 1, 418/97, 270; 184/6.16

(56) References Cited

U.S. PATENT DOCUMENTS

| | | | | | |
|---|---|---|---|---|---|
| 4,295,806 | A | * | 10/1981 | Tanaka et al. | 418/97 |
| 5,012,896 | A | | 5/1991 | Costa | |
| 5,222,885 | A | * | 6/1993 | Cooksey | 418/96 |
| 5,345,785 | A | | 9/1994 | Sekigami | |

FOREIGN PATENT DOCUMENTS

| | | | | | |
|---|---|---|---|---|---|
| JP | 54154812 | A | * | 12/1979 | F04C/29/02 |
| JP | 58152195 | A | * | 9/1983 | F04C/29/02 |
| JP | 02019689 | A | * | 1/1990 | F04C/29/02 |
| JP | 06074179 | A | * | 3/1994 | F04C/29/00 |
| JP | 06088584 | A | * | 3/1994 | F04C/23/00 |

OTHER PUBLICATIONS

Patent Abstracts of Japan vol. 1995, No. 11, Dec. 26, 1995 & JP 07 208357 A (Hitachi Ltd) Aug. 8, 1995.

Patent Abstracts of Japan vol. 1995, No. 06, Jul. 31, 1995 & JP 07 083185 (Toshiba Corp), Mar. 28, 1995.

Copy of European Patent Office Communication.

* cited by examiner

*Primary Examiner*—Theresa Trieu

(74) *Attorney, Agent, or Firm*—Westerman, Hattori, Daniels & Adrian, LLP

(57) ABSTRACT

There is provided a horizontal rotary compressor capable of improving performance thereof while an oil supply means smoothly supplies oil. A part of a hermetic shell case at the upper side is partitioned by a baffle into an electric element side and an oil pump side, a refrigerant which is drawn from an outside of the hermetic shell case is compressed by a first rotary compression element and a second rotary compression element and discharged toward the electric element side of the baffle, then it is further discharged from oil pump side toward the outside of the hermetic shell case. The baffle closes a flow path area of the refrigerant over an oil level inside the hermetic shell case at a ratio ranging from not less than 50% to not more than 80% during the stoppage of the horizontal rotary compressor.

4 Claims, 6 Drawing Sheets

Pressure A > Pressure B > Pressure C

During operation of horizontal rotary compressor

Pressure A = Pressure B = Pressure C

During stoppage of horizontal rotary compressor

Pressure A > Pressure B > Pressure C

During operation of horizontal rotary compressor

Pressure A = Pressure B

During stoppage of horizontal rotary compressor

Pressure A > Pressure B

During stoppage of horizontal rotary compressor

HORIZONTAL COMPRESSOR

FIELD OF THE INVENTION

The present invention relates to a horizontal rotary compressor for discharging refrigerant compressed by rotary compression elements into a hermetic shell case.

BACKGROUND OF THE INVENTION

A conventional horizontal rotary compressor is configured such that refrigerant which has been drawn through a suction port of each rotary compression element into a lower pressure chamber side of the cylinder, and compressed by the operations of rollers and a vane, and is discharged from a high pressure chamber side of a cylinder into a hermetic shell case through a discharge port and a discharge silencer chamber, then flows into an external radiator and the like. Further, a bottom portion of the hermetic shell case serves as an oil reservoir and oil is drawn up from oil reservoir by an oil pump (oil supply means) attached to the opposite side of the electric element of each rotary compression element and is supplied to each rotary compression element to prevent abrasion of each rotary compression element.

With the horizontal rotary compressor having such an arrangement, although oil which is mixed with a refrigerant compressed by each rotary compression element is discharged into the hermetic shell case together with the refrigerant, the refrigerant is once discharged toward the electric element of the cylinder so as to facilitate separation of oil from the refrigerant and it is also discharged outside the hermetic shell case through oil pump side. Accordingly, oil is reserved not only in oil pump side but also in the electric element side, causing a problem that oil is not smoothly drawn if an oil level in oil pump is lowered.

Accordingly, the conventional horizontal rotary compressor has been contrived such that a baffle plate is disposed in the electric element side of the rotary compression element and the interior of the hermetic shell case is partitioned into the electric element side and the rotary compression element and an oil pump side so that a difference in pressure occurs therebetween, wherein the pressure inside the hermetic shell case is set such that the pressure at the side of the each rotary compression element and oil pump side is lower than that at the electric element side so as to raise oil level in oil pump side.

Since the baffle plate provided in the conventional horizontal rotary compressor has a given interval between the substantially peripheral portion thereof and the inner surface of the hermetic shell case so that the difference in pressure occurs therebetween, accordingly, if the interval therebetween is large, it causes a problem that the difference in pressure therebetween does not occur efficiently. On the other hand, if the interval therebetween is narrowed, the moving of the refrigerant and oil inside the hermetic shell case is inhibited.

SUMMARY OF THE INVENTION

The invention has been developed to solve the problems of the conventional horizontal rotary compressor and it is an object of the invention to provide a horizontal rotary compressor capable of improving performance thereof while an oil supply means smoothly supplies oil.

To achieve the above object, the horizontal rotary compressor of the invention comprises an electric element, a rotary compression mechanism which is driven by the electric element, the rotary compression mechanism comprised of a first rotary compression element and a second rotary compression element, lubricant stored in an oil reservoir at the bottom inside the hermetic shell case, an oil supply means provided at an opposite side of the electric element of the rotary compression mechanism for supplying oil to the rotary compression mechanism, wherein a part of the hermetic shell case at the upper side is partitioned by a baffle plate into the electric element side and oil supply means side, a refrigerant which is drawn from an outside of the hermetic shell case is compressed by the rotary compression mechanism and discharged toward the electric element side of the baffle plate, then it is further discharged from oil pump side toward the outside of the hermetic shell case, whereby the portion positioned under oil level is partitioned by oil while the portion positioned over oil level is closed to the extent not to inhibit the circulation of the refrigerant so that a pressure in the hermetic shell case is set such that a pressure at oil supply means is lower than a pressure at the electric element of the baffle plate.

Owing to the difference in pressure, oil reserved in the bottom inside the hermetic shell case is moved toward oil supply means of the baffle plate and is drawn by oil supply means provided therein so that oil can be smoothly supplied to sliding portions of the rotary compression mechanism.

Particularly, since the baffle plates do not partition the bottom inside the hermetic shell case in this case, movement of oil is not inhibited. As a result, the electric element can be smoothly cooled by oil, and the supply of oil is surely carried out while oil level at oil supply means side is secured, thereby ensuring various performances of the compressor such as suction, compression, discharge of the refrigerant as a whole.

According to the second aspect of the invention, in addition to the first aspect of the invention, since the baffle plates close a flow path area of the refrigerant over an oil level inside the hermetic shell case at a ratio ranging from not less than 50% to not more than 80% during the stoppage of the horizontal rotary compressor, a problem which obstructs the circulation of the refrigerant can be solved while the difference in pressure is properly maintained.

PREFERRED EMBODIMENT OF THE INVENTION

Figure 1:
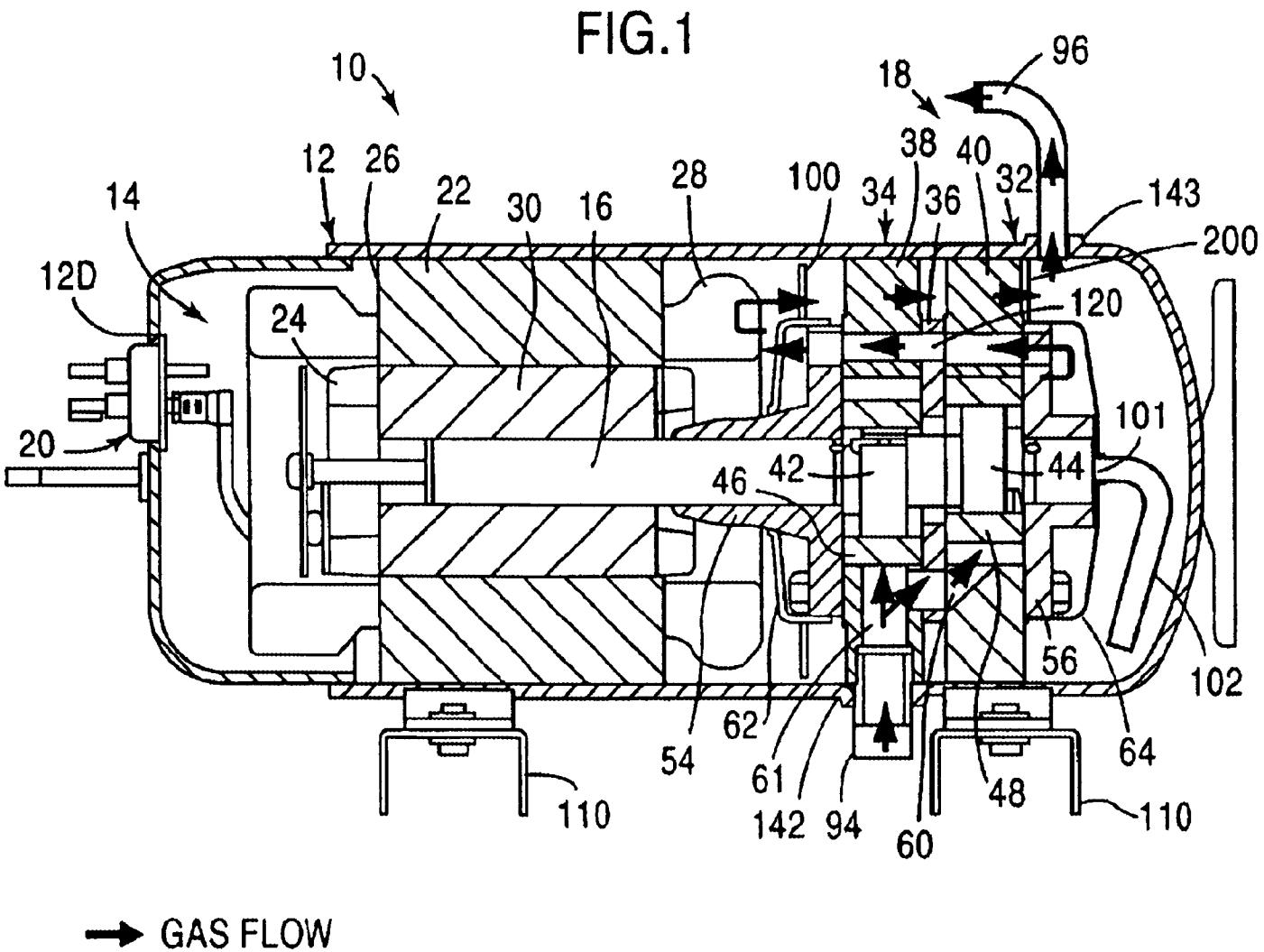
FIG. 1 is longitudinal sectional view of a horizontal rotary compressor according to the invention.
Figure 2:
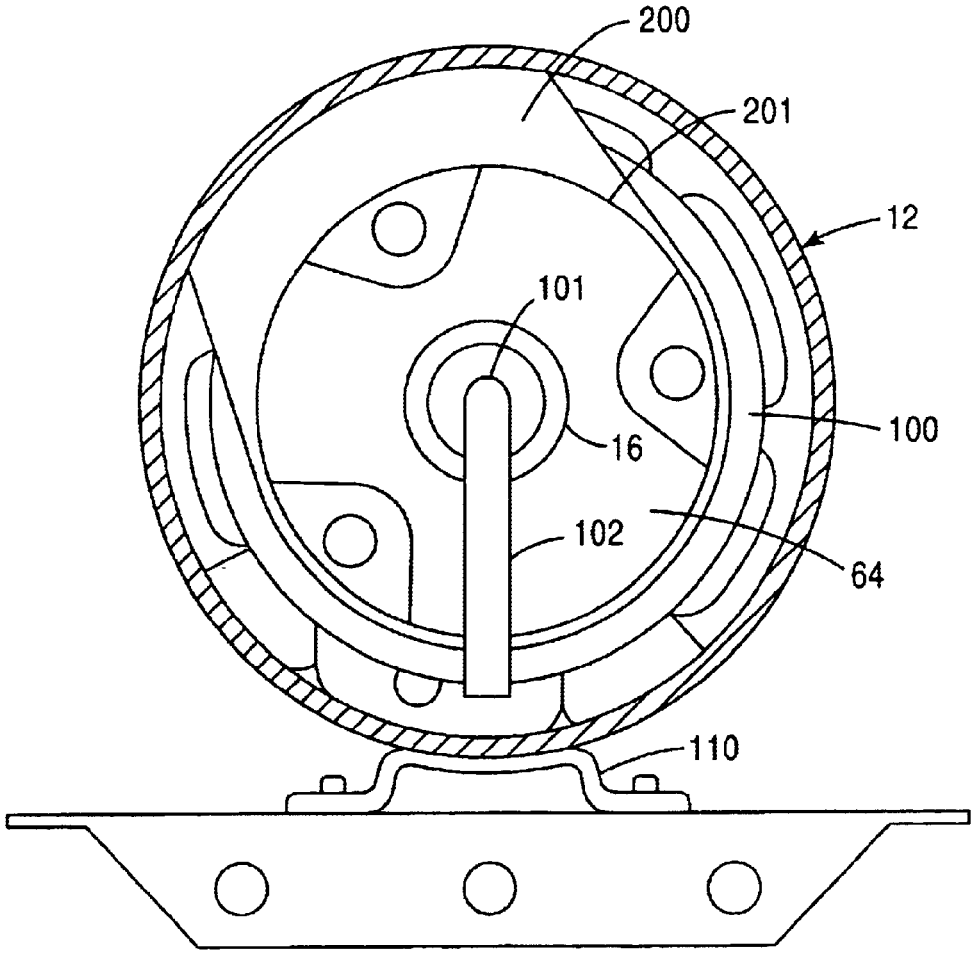
FIG. 2 is a longitudinal sectional view of the horizontal rotary compressor shown in FIG. 1.

A preferred embodiment of the invention is now described with reference to the attached drawings. FIG. 1 is longitudinal sectional view of a horizontal rotary compressor according to the invention provided with first and second rotary compression elements showing the first embodiment of the invention, and FIG. 2 is a longitudinal sectional view of the horizontal rotary compressor shown in FIG. 1.

In each figure, the horizontal rotary compressor 10 is formed of an internal high pressure type horizontal rotary compressor and comprises a long sideways cylindrical hermetic shell case 12 which is closed in both ends, wherein the bottom inside the hermetic shell case 12 serves as an oil reservoir. An electric element 14 and a rotary compressor mechanism 18 comprising a first rotary compression element 32 and a second rotary compression element 34 which are respectively driven by a rotary shaft of the electric element 14 are respectively accommodated in the hermetic shell case 12.

A circular mounting slot 12D is formed in the end portion of the electric element 14 side of the hermetic shell case 12 and a terminal 20 through which power is supplied to the electric element 14 is attached to this slot 12D.

The electric element 14 comprises a stator 22 fixed annularly along the inner peripheral surface of the hermetic shell case 12 and a rotor 24 inserted into and installed on the stator 22 with a clearance slightly relative to the inner side of the stator 22. The rotor 24 is fixed to a rotary shaft 16 which pierces the center of the hermetic shell case 12 and extends in the axial direction (lateral direction) thereof.

The stator 22 comprises a laminated body 26 formed by laminating doughnut-shaped flat rolled magnetic steel sheets and a stator coil 28 which is wound around the teeth of the laminated body 26 by a direct winding (concentrating winding) system. The rotor 24 is also formed of a laminated body 30 of flat rolled magnetic steel sheets like the stator 22.

An oil pump 101 serving as an oil supply means is formed on the side opposite to the electric element 14 of the first and second rotary compression element 32, 34, namely, at the end of the rotary compressor mechanism 18 of the rotary shaft 16. The oil pump 101 is provided for drawing lubricant from oil reservoir formed on the bottom inside the hermetic shell case 12 and supplying oil to the sliding portions of the rotary compressor mechanism 18, thereby preventing abrasion. An oil suction pipe 102 extends downward from oil pump 101 toward the bottom of the hermetic shell case 12 and opens to oil reservoir.

The first rotary compression element 32 and second rotary compression element 34 are formed of first and second cylinders 38, 40 and an intermediate partition board 36 is clamped between the first and second cylinders 38, 40. That is, the rotary compressor mechanism 18 comprises the first rotary compression element 32, second rotary compression element 34 and the intermediate partition board 36.

The first and second rotary compression element 32, 34 comprise first and second cylinders 38, 40 which are disposed at both sides (right and left in FIG. 1) of the intermediate partition board 36, first and second rollers 46, 48 which are engaged with first and second eccentric portions 42, 44 provided on the rotary shaft 16 with 180 degrees phase difference and eccentrically rotated inside the first and second cylinders 38, 40, a vane, not shown, which is brought into contact with the first and second rollers 46, 48 and partitions the first and second cylinders 38, 40 into a lower pressure chamber and a high pressure chamber, and supporter members 54, 56 for closing opening face of the electric element 14 side of the first cylinder 38 and an opening face of the side (oil pump 101 side) opposite to the electric element 14 of the second cylinder 40 to serve as a bearing of the rotary shaft 16.

A suction path 61 is formed in the first cylinder 38 for communicating with the lower pressure chamber side inside the first cylinder 38 through a suction port, not shown. Further, a suction path 60 is formed in the second cylinder 40 and intermediate partition board 36 for communicating with the lower pressure chamber side inside the second cylinder 40 through a suction port, not shown. These suction paths 61, 60 communicate with one end of a refrigerant introduction pipe 94, described later and a refrigerant is supplied to the cylinders 38, 40 from the refrigerant introduction pipe 94 through the suction paths 61, 60 and a suction port, not shown.

The refrigerant which is compressed by the first and second cylinders 38, 40 is discharged into discharge silencer chambers 62, 64 which are formed in the electric element 14 side of the support member 54 and the side opposite to the electric element 14 of the support member 56 through discharge ports, not shown, of the support members 54, 56. The rotary shaft 16 and the holes through which the support members 54, 56 serving as bearings of the rotary shaft 16 penetrate are formed in the discharge silencer chambers 62, 64 which cover the electric element 14 side of the support member 54 and oil pump 101 side of the support member 56.

The discharge silencer chambers 62, 64 communicate with each other through a communication path 120 which opens to the discharge silencer chamber 62 upon penetration of the first and second cylinders 38, 40 and intermediate partition board 36. High pressure refrigerant which is compressed by the first rotary compression element 32 is discharged from the communication path 120 into the discharge silencer chamber 62 through the discharge silencer chamber 64, and merge high pressure refrigerant which is compressed by the second rotary compression element 34, and the merged refrigerants are discharged into the electric element 14 side of the hermetic shell case 12 through a discharge pipe, not shown. At this time, although oil which was supplied to the first and second rotary compression element 32, 34 is mixed in the refrigerant, this oil is also discharged into the electric element 14 side of the hermetic shell case 12. The oil mixed in the refrigerant is separated thereafter from the refrigerant and is reserved in the reservoir formed on the bottom inside the hermetic shell case 12.

Baffle plates 100 and 200 are formed on the outer peripheral surfaces of the discharge silencer chambers 62 and 64. The baffle plate 100 is formed on the outer peripheral surface of the discharge silencer chamber 62 and is formed of a doughnut shaped steel plate and fixed to the discharge silencer chamber 62 by welding a connecting portion between itself and the discharge silencer chamber 62. The baffle plate 100 is close to the inner surface of the hermetic shell case 12 substantially at the entire periphery thereof and there is formed a sufficient interval between the baffle plate 100 and the hermetic shell case 12 to the extent of the occurrence of a difference in pressure between the electric element 14 side and the rotary compressor mechanism 18 side. Although a slight difference in pressure occurs when the refrigerant which is compressed by the first and second rotary compression element 32, 34 and is discharged into the electric element 14 side of the baffle plate 100 passes through a clearance formed between the hermetic shell case 12 and the baffle 100, the refrigerant which is discharged into the electric element 14 side flows into the rotary compressor mechanism 18 side without trouble.

Meanwhile, the baffle plate 200 is formed on the outer peripheral surface of the discharge silencer chamber 64 and partitions a part of the upper portion of the hermetic shell case 12 into the electric element 14 side and oil pump 101 side (namely, a side where oil supply means is present). The baffle plate 200 has a circular hole 201 through which the discharge silencer chamber 64 penetrates as shown in FIG. 2, and the circular hole 201 is engaged in the discharge silencer chamber 64 and welded to the discharge silencer chamber 64 at the connection portion therebetween so that the baffle plate 200 is fixed to the discharge silencer chamber 64. The baffle plate 200 closes a flow path area of the refrigerant over an oil level inside the hermetic shell case 12 at a ratio ranging from not less than 50% to not more than 80% during the stoppage (FIG. 3) of the horizontal rotary compressor.

The baffle plate 200 does not close the lower portion of the hermetic shell case 12 so that the interior of the hermetic shell case 12 under the baffle plate 200 is filled with oil inside oil reservoir and it is partitioned by oil. Since the upper portion inside the hermetic shell case 12 is closed to the extent not to inhibit the circulation of the refrigerant owing to the baffle plate 200, a refrigerant which is discharged into the electric element 14 side inside the hermetic shell case 12 and passes through the baffle plate 100 also passes through the upper portion inside the hermetic shell case 12 and flows into oil pump 101 side, while a difference in pressure occurs by the baffle plate 200 between the electric element 14 side and oil pump 101 side (the pressure B at the electric element 14 side of the baffle plate 200 is higher but the pressure C at oil pump 101 side is lower as shown in FIG. 4).

Figure 4:
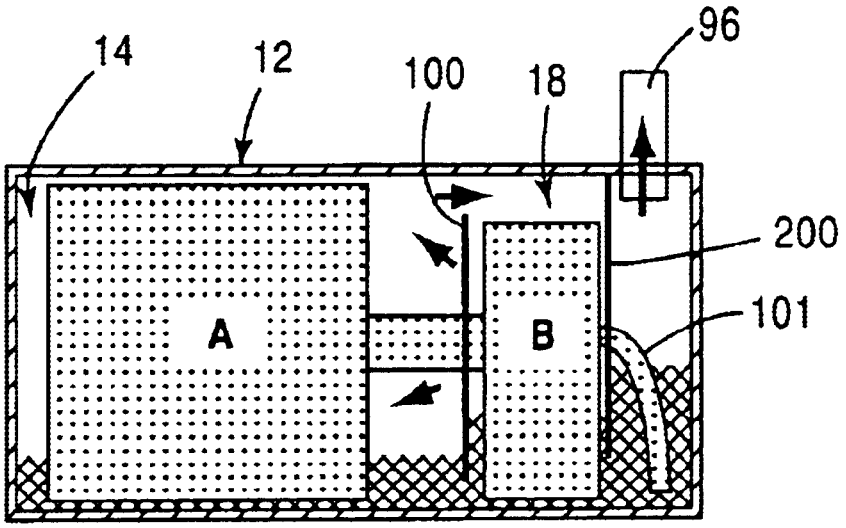
FIG. 4 is a view showing an oil level inside a hermetic shell case during the operation of the horizontal rotary compressor shown in FIG. 1.
Figure 5:
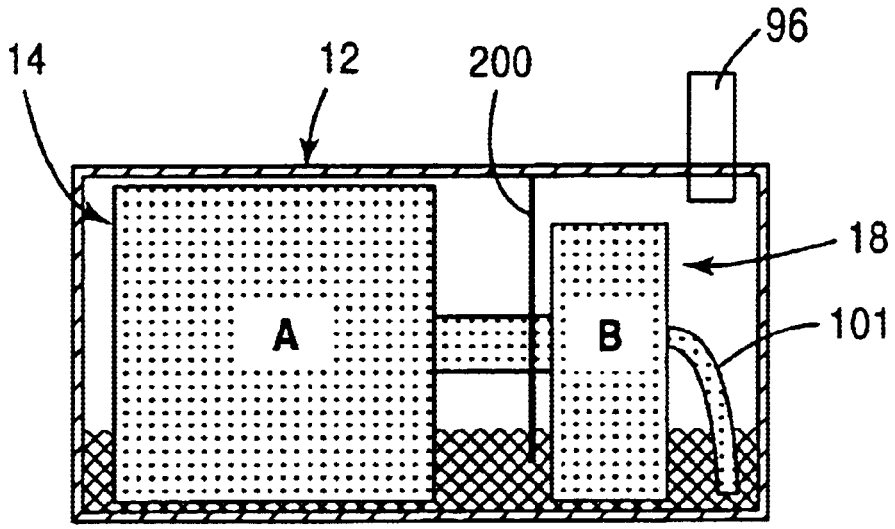
FIG. 5 is a view showing an oil level inside a hermetic shell case during the stoppage of the horizontal rotary compressor according to a second embodiment of the invention.
Figure 6:
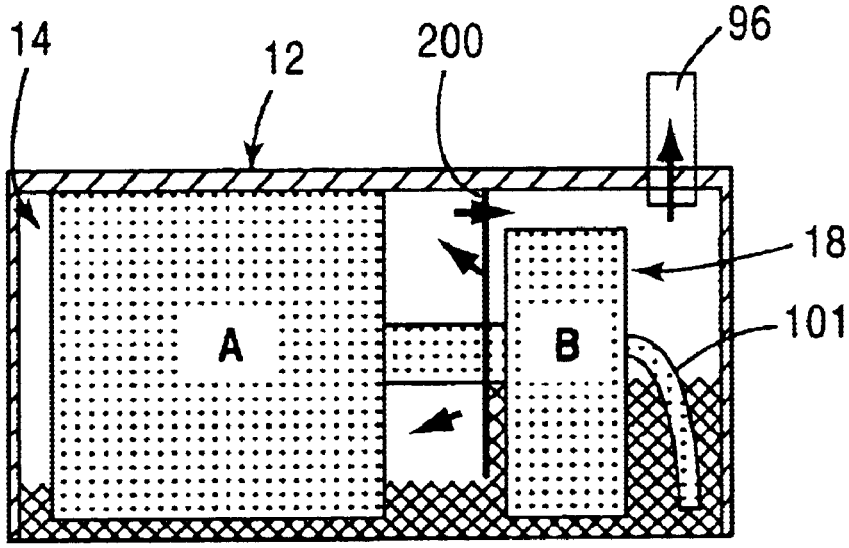
FIG. 6 is a view showing an oil level inside a hermetic shell case during the operation of the horizontal rotary compressor shown in FIG. 5.

Oil which is reserved in oil reservoir formed on the bottom inside the hermetic shell case 12 is moved toward oil pump 101 side owing to the difference in pressure, and oil level at oil pump 101 side is raised by the baffle plate 200 (FIG. 4). Consequently, the opening of oil suction pipe 102 is immersed in oil without trouble, so that oil can be smoothly supplied to the sliding portions of the rotary compressor mechanism 18 by oil pump 101.

Although there occurs the difference in pressure between the electric element 14 side and oil pump 101 side such that the pressure at the electric element 14 side is higher and that at oil pump 101 side is lower so that oil reserved in the electric element 14 side of the baffle plate 200 is moved toward oil pump 101 side, oil remains also on the bottom at the electric element 14 side and it can be freely moved between both sides of the baffle plate 200 because the lower portion inside the hermetic shell case 12 is not partitioned by the baffle plate200.

As a result, the electric element 14 can be cooled by oil having excellent thermal conduction while securing an oil level at oil pump 101 side of the baffle plate 200, so that the operating performance and the circulation of refrigerant can be improved, thereby ensuring various performances of the compressor such as suction, compression, discharge of refrigerant as a whole.

Further, since the refrigerant discharged into the hermetic shell case 12 passes through the clearances between the hermetic shell case 12 and the baffle plate 100, baffle plate 200, oil mixed in the refrigerant can be efficiently separated from the refrigerant, the amount of oil discharged together with the refrigerant into the outside of the horizontal rotary compressor 10 through a refrigerant discharge pipe 96 can be significantly reduced.

An existing oil such as mineral oil, alkylbenzene oil, ether oil, ester oil, PAG (polyalkyl glycol) is used as a lubricant to be sealed in the hermetic shell case 12.

Sleeves 142, 143 are formed at the side surfaces of the hermetic shell case 12 at the portions corresponding to the first cylinder 38 and discharge silencer chamber 64. One end of the refrigerant introduction pipe 94 for introducing a refrigerant in the first and second cylinder 38, 40 is inserted into and connected to the interior of the sleeve 142. The refrigerant introduction pipe 94 communicates with the suction path 60 of the first rotary compression element 32 and a suction path of the second rotary compression element 34, not shown. The refrigerant suction pipe 96 is inserted into the sleeve 143 and one end of the refrigerant suction pipe 96 communicates with the interior of the hermetic shell case 12, whereby refrigerant which is discharged into the electric element 14 of the hermetic shell case 12 and returned to oil pump 101 side is supplied to an exterior radiator, not shown, through the refrigerant suction pipe 96. Further, a fixing pedestal 110 is provided on the bottom of the hermetic shell case 12.

Figure 3:
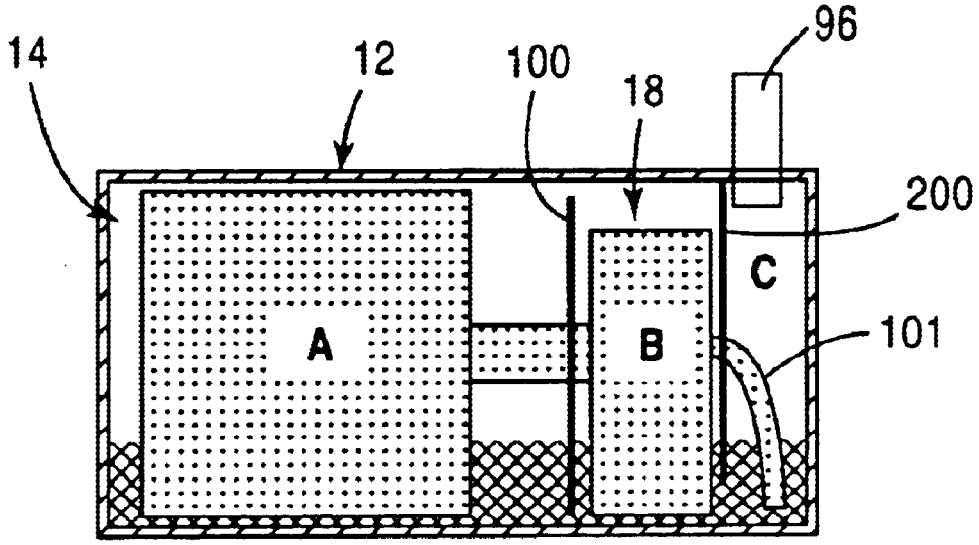
FIG. 3 is a view showing an oil level inside a hermetic shell case during the stoppage of the horizontal rotary compressor shown in FIG. 1.

Described next is the operation of the horizontal rotary compressor 10 having the configuration set forth above. FIGS. 3 and 4 show an oil level inside the hermetic shell case 12 during the stoppage and the operation of the horizontal rotary compressor 10. First, during the stoppage of the horizontal rotary compressor 10, oil inside the hermetic shell case 12 has the same oil level at the bottom inside the hermetic shell case 12 because a pressure A at the electric element 14 side, a pressure B between the baffle 100 plate and the baffle plate 200 (pressure at the rotary compressor mechanism 18) and a pressure C at the side of oil pump 101 side are the same with one another as shown in FIG. 3.

When the stator 28 of the electric element 14 is energized via the terminal 20 and wiring, not shown, the electric element 14 is started to rotate the rotor 24. When the rotor 24 is rotated, the first and second rollers 46, 48 engaged with the first and second eccentric portions 42, 44 provided integrally with the rotary shaft 16 are eccentrically rotated inside the first and second cylinder 38, 40.

As a result, a refrigerant is drawn respectively into the lower pressure chamber of the second cylinder 40 of the first rotary compression element 32 or into the lower pressure chamber of the first cylinder 38 of the second rotary compression element 34 through suction ports of the suction paths 61, 60, not shown. The refrigerant which is drawn into the lower pressure chamber side of the second cylinder 40 is compressed to become higher pressure by the operations of the roller 48 and a vane, not shown, to become higher pressure, and it is discharged from the high pressure chamber of the second cylinder 40 into the discharge silencer chamber 64 via the discharge port, not shown, then it is discharged into the discharge silencer chamber 62 through the communication path 120, and merges with the refrigerant which is compressed inside the first cylinder 38.

Meanwhile, the refrigerant which is drawn into the low pressure chamber side of the first cylinder 38 is compressed by the operation of the roller 46 and the vane, not shown, to become high pressure, and it is discharged from the high pressure chamber side of the first cylinder 38 into the discharge silencer chamber 62 via the discharge port, not shown, and merges with the refrigerant which is compressed inside the second cylinder 40. The high pressure refrigerant which merged with the refrigerant which is compressed inside the second cylinder 40 is discharged into the electric element 14 side inside the hermetic shell case 12 (electric element 14 side of the baffle plate 100) through the discharge port, not shown. At this time, oil which is supplied to the first and second rotary compression element 32, 34 is mixed in the refrigerant which is discharged into the electric element 14 side inside the hermetic shell case 12, this oil is separated from the refrigerant and is reserved in oil reservoir provided on the bottom inside the hermetic shell case 12. The refrigerant flows into the rotary compressor mechanism 18 side through a clearance formed between the baffle plate 100 and the hermetic shell case 12.

Owing to the operation that the refrigerant passes through the clearance formed between the baffle plate 100 and the hermetic shell case 12, the pressure A at the electric element 14 side is slightly higher than the pressure B at the rotary compressor mechanism 18 side. At this time, oil mixed in the refrigerant can be separated from the refrigerant when it passes through the clearance formed between the baffle plate 100 and the hermetic shell case 12.

Then, the refrigerant passes through the clearance formed between the baffle plate 200 and the upper portion inside the hermetic shell case 12 and flows into oil pump 101 side. Owing to the operation that the refrigerant passes through the clearance formed between the baffle 200 and the upper portion inside the hermetic shell case 12, the pressure C at oil pump 101 side becomes lower than the pressure B between the baffle plate 100 and the baffle plate 200. Owing to the difference in pressure, oil inside the hermetic shell case 12 is prone to flow into oil pump 101 side, oil level at oil pump 101 rises as shown in FIG. 4. As a result, oil is smoothly drawn up by oil pump 101 via oil suction pipe 102.

Meanwhile, although oil level at the rotary compressor mechanism 18 side lowers, the lower portion inside the hermetic shell case 12 is not partitioned by the baffle plate 200, and hence oil can freely move in the lower portion inside the hermetic shell case 12 so that oil level for cooling the electric element 14 side can be secured. As a result, the electric element 14 can be smoothly cooled by oil as the supply of oil is surely carried out while oil level at oil supply pump 101 side is secured, thereby ensuring various performances of the compressor such as suction, compression, discharge of refrigerant as a whole.

Further, oil mixed in the refrigerant can be further separated from the refrigerant when it passes through the clearance formed between the baffle plate 200 and the hermetic shell case 12. The higher pressure refrigerant, that flows into the rotary compressor mechanism 18 side flows from the refrigerant discharge tube 96 into an external radiator.

A part of a hermetic shell case 12 at the upper side is partitioned by the baffle plate 200 into the electric element 14 side and oil pump 101 side, the refrigerant which is drawn from an outside of the hermetic shell case 12 is compressed by the first rotary compression element 32 and the second rotary compression element 34 and discharged toward the electric element 14 side of the baffle 200, then it is further discharged from oil pump 101 side toward the outside of the hermetic shell case 12 via the baffle plate 100 and the baffle plate 200 so that a slight difference in pressure occurs by the baffle plate 100 between the electric element 14 side and the rotary compressor mechanism 18 side of the baffle plate 100 while the lower portion of oil level is partitioned by the baffle plate 200 while the upper portion of oil level is closed to the extent not to inhibit the circulation of the refrigerant so that the pressure in the hermetic shell case 12 becomes such that the pressure at oil pump 101 side becomes lower than the pressure at the electric element 14 side. Owing to the difference in pressure, oil reserved in the bottom inside the hermetic shell case 12 is moved toward the rotary compressor mechanism 18 side of the baffle plate 200 and is drawn by oil pump 101 provided therein so that oil can be smoothly supplied to the sliding portions of the first and second rotary compression element 32, 34.

Since the baffle plate 200 does not close the lower portion inside the hermetic shell case 12, oil remains also at the electric element 14 side so that the electric element 14 can be cooled by oil, so that oil level at oil pump 101 side is secured and the cooling performance of the electric element 14 can be secured as the supply of oil is performed reliably.

Further, since the refrigerant discharged into the hermetic shell case 12 passes through the clearances between the hermetic shell case 12 and the baffle plate 100, baffle plate 200, oil mixed in the refrigerant can be efficiently separated from the refrigerant, so that the amount of oil discharged together with the refrigerant into the outside of the horizontal rotary compressor 10 through a refrigerant discharge pipe 96 can be significantly reduced.

Further, since the baffle plate 200 closes a flow path area of the refrigerant over the oil level inside the hermetic shell case 12 at a ratio ranging from not less than 50% to not more than 80% during the stoppage of the horizontal rotary compressor, a problem that the circulation of refrigerant is obstructed by the baffle plate 100 does not occur, so that oil can be supplied more reliably.

Second Embodiment

Although the baffle plate 100 and baffle plate 200 have been proved in the first embodiment, only the baffle plate 200 for partitioning the part of the upper portion inside a hermetic shell case 12 may be provided at an electric element 14 side of a rotary compressor mechanism 18. Even in this case, when a horizontal rotary compressor 10 is operated, a difference in pressure occurs between the electric element 14 side, a rotary compressor mechanism 18 and an oil pump 101 side, whereby an oil level inside the hermetic shell case 12 becomes such that oil level at the electric element 14 side becomes low while that at oil pump 101 side is high. Further, since oil level at the electric element 14 side can be secured, the electric element 14 can be cooled by oil.

That is, the supply of oil is surely carried out while securing oil level at oil pump 101 side of the baffle plate 200 by the baffle plate 200 alone provided between the electric element 14 and the rotary compressor mechanism 18 and the electric element 14 can be smoothly cooled by oil while oil level at oil supply means side is secured, thereby ensuring various performances of the compressor such as suction, compression, discharge of refrigerant as a whole. Particularly, in this case the baffle 100 can be eliminated, and the number of parts can be reduced.

Although the horizontal rotary compressor has been used in the first and second embodiments of the invention, the invention is effective even if a single cylinder type horizontal rotary compressor or a multistage horizontal rotary compressor of an internal intermediate pressure type is used.

As described in detail above, since the horizontal rotary compressor comprises a horizontal hermetic shell case, an electric element housed in the hermetic shell case, a rotary compression mechanism which is driven by the electric element and comprised of a first rotary compression element and a second rotary compression element, lubricant stored in an oil reservoir at the bottom inside the hermetic shell case, an oil supply means provided at an opposite side of the electric element of the rotary compression mechanism for supplying oil to the rotary compression mechanism, wherein a part of the hermetic shell case at the upper side is partitioned by a baffle plate into the electric element side and oil supply means side, a refrigerant which is drawn from an outside of the hermetic shell case is compressed by the rotary compression mechanism and discharged toward the electric element side of the baffle plate, then it is further discharged from oil supply means side toward the outside of the hermetic shell case, the lower portion over oil level is partitioned by oil, and the upper portion under oil level is closed to the extent not to inhibit the circulation of the refrigerant so that the pressure inside hermetic shell case becomes such that the pressure at the oil supply means is lower than that at the electric element side of the baffle plate.

Owing to the difference in pressure, oil reserved in the bottom inside the hermetic shell case is moved toward oil supply means side of the baffle plate and is drawn by oil supply means so that oil can be smoothly supplied to the sliding portions of the rotary compressor mechanism and the like.

Particularly, in this case, the baffle plate does not partition the bottom inside the hermetic shell case so that the movement of oil is not obstructed. As a result, the electric element can be smoothly cooled by oil, and the supply of oil is surely carried out while oil level at oil supply means side is secured, thereby ensuring various performances of the compressor such as suction, compression, discharge of refrigerant as a whole.

According to the second aspect of the invention, in addition to the first aspect of the invention, since the baffle plate closes a flow path area of the refrigerant over an oil level inside the hermetic shell case at a ratio ranging from not less than 50% to not more than 80% during the operation of the horizontal rotary compressor, a problem which obstructs the circulation of refrigerant can be solved while the difference in pressure is properly maintained.

What is claimed is:

1. A horizontal rotary compressor comprising:

a horizontal hermetic shell case;

an electric element housed in the hermetic shell case;

a rotary compression mechanism which is driven by the electric element;

said rotary compression mechanism comprised of a first rotary compression element and a second rotary compression element;

lubricant stored in an oil reservoir at the bottom inside the hermetic shell case;

an oil supply means provided at an opposite side of the electric element of the rotary compression mechanism for supplying oil to the rotary compression mechanism;

wherein a part of the hermetic shell case at the upper side is partitioned by a baffle plate (200) into the electric element side and oil supply means side, a refrigerant which is drawn from an outside of the hermetic shell case is compressed by the rotary compression mechanism and discharged toward the electric element side of the baffle plate (200), then it is further discharged from oil supply means side toward the outside of the hermetic shell case, whereby the portion positioned under oil level is partitioned by oil while the portion positioned over oil level is closed to the extent not to inhibit the circulation of the refrigerant so that a pressure in the hermetic shell case is set such that a pressure at oil supply means is lower than a pressure at the electric element of the baffle plate (200), wherein said baffle plate (200) is positioned between said oil supply means and said rotary compression mechanism.

2. The horizontal rotary compressor according to claim 1, wherein the baffle plate (200) closes a flow path area of the refrigerant over an oil level inside the hermetic shell case at a ratio ranging from not less than 50% to not more than 80% during the stoppage of the horizontal rotary compressor.

3. The horizontal rotary compressor comprising:

a horizontal hermetic shell case;

an electric element housed in the hermetic shell case;

a rotary compression mechanism which is driven by the electric element;

said rotary compression mechanism comprised of a first rotary compression element and a second rotary compression element;

lubricant stored in an oil reservoir at the bottom inside the hermetic shell case;

an oil supply means provided at an opposite side of the electric element of the rotary compression mechanism for supplying oil to the rotary compression mechanism;

wherein a part of the hermetic shell case at the upper side is partitioned by a baffle plate (200) into the electric element side and oil supply means side, a refrigerant which is drawn from an outside of the hermetic shell case is compressed by the rotary compression mechanism and discharged toward the electric element side of the baffle plate (200), then it is further discharged from oil supply means side toward the outside of the hermetic shell case, whereby the portion positioned under oil level is partitioned by oil while the portion positioned over oil level is closed to the extent not to inhibit the circulation of the refrigerant so that a pressure in the hermetic shell case is set such that a pressure at oil supply means is lower than a pressure at the electric element of the baffle plate (200), wherein said baffle plate (200) is a first baffle plate (200), wherein said first baffle plate (200) is positioned between said oil supply means and said rotary compression mechanism, wherein said horizontal rotary compressor further comprises a second baffle plate (100), and wherein said second baffle plate (100) is positioned between rotary compression mechanism and said electric element.

4. The horizontal rotary compressor according to claim 3, wherein said first baffle plate (200) and said second baffle plate (100) close a flow path area of the refrigerant over an oil level inside the hermetic shell case at a ratio ranging from not less than 50% to not more than 80% during the stoppage of the horizontal rotary compressor.

* * * * *